US011101535B2

(12) United States Patent
Seo

(10) Patent No.: US 11,101,535 B2
(45) Date of Patent: Aug. 24, 2021

(54) TRANSMISSION LINE-WAVEGUIDE TRANSITION DEVICE COMPRISING A WAVEGUIDE HAVING A RIDGE CONNECTED TO THE TRANSMISSION LINE AT A REDUCED WIDTH GROUND TRANSITION AREA

(71) Applicant: KMW INC., Hwaseong-si (KR)

(72) Inventor: Yong-Won Seo, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 16/522,653

(22) Filed: Jul. 26, 2019

(65) Prior Publication Data

US 2019/0348740 A1 Nov. 14, 2019

Related U.S. Application Data

(63) Continuation of application No. PCT/KR2018/001047, filed on Jan. 24, 2018.

(30) Foreign Application Priority Data

Jan. 26, 2017 (KR) ..... 10-2017-0012484

(51) Int. Cl.

| | |
|---|---|
| ***H01P 5/107*** | (2006.01) |
| ***H01P 5/10*** | (2006.01) |
| ***H01P 5/103*** | (2006.01) |
| *H01P 3/123* | (2006.01) |

(52) U.S. Cl.

CPC ..... *H01P 5/107* (2013.01); *H01P 5/103* (2013.01); *H01P 5/1022* (2013.01); *H01P 3/123* (2013.01)

(58) Field of Classification Search

CPC ..... H01P 5/107; H01P 5/103
USPC ..... 333/26
See application file for complete search history.

(56) References Cited

U.S. PATENT DOCUMENTS 3,969,691 A * 7/1976 Saul ..... H01P 1/16 333/21 R
4,754,239 A * 6/1988 Sedivec ..... H01P 5/107 333/26
5,408,188 A * 4/1995 Katoh ..... G01R 1/06772 324/756.03
6,917,256 B2 7/2005 Emrick et al.
(Continued)

FOREIGN PATENT DOCUMENTS

JP S61-142802 A 6/1986
JP H3-111008 U 11/1991
(Continued)

OTHER PUBLICATIONS

International Search Report for PCT/KR2018/001047 dated May 1, 2018 and its English translation.
(Continued)

*Primary Examiner* — Benny T Lee

(57) ABSTRACT

Disclosed is a transmission line-waveguide transition device including side surfaces and a top surface having a size and shape corresponding to a waveguide to which a signal of a transmission line is transmitted, the side surfaces and top surface having a plate shape; and a plate-shaped ridge formed in an inner space defined by the side surfaces and the top surface, the ridge being provided with a slope having one end connected to the transmission line and an opposite end contacting the top surface.

12 Claims, 18 Drawing Sheets

(56) References Cited

U.S. PATENT DOCUMENTS

| | | | |
|---|---|---|---|
| 8,188,805 | B2 | 5/2012 | Nomura et al. |
| 2002/0153397 | A1 | 11/2002 | Buck |
| 2004/0263277 | A1 | 12/2004 | Ding et al. |

FOREIGN PATENT DOCUMENTS

| | | | |
|---|---|---|---|
| JP | H6-34715 | A | 2/1994 |
| JP | 6040601 | B2 | 5/1994 |
| JP | 07-202524 | A | 8/1995 |
| JP | H10-126116 | A | 5/1998 |
| JP | 2001-292011 | A | 10/2001 |
| JP | 2002-344212 | A | 11/2002 |
| JP | 2005-27299 | A | 1/2005 |
| JP | 2005-539461 | A | 12/2005 |
| KR | 10-0907271 | B1 | 7/2009 |
| KR | 10-0998207 | B1 | 12/2010 |
| KR | 10-1055425 | B1 | 8/2011 |
| WO | 2011-136737 | A1 | 11/2011 |

OTHER PUBLICATIONS

Japanese office action dated Aug. 18, 2020 for Japanese Application No. 2019-540084.
Chinese office action dated Dec. 29, 2020 for Chinese Application No. 201880008508.2 and its English translation.

* cited by examiner

TRANSMISSION LINE-WAVEGUIDE TRANSITION DEVICE COMPRISING A WAVEGUIDE HAVING A RIDGE CONNECTED TO THE TRANSMISSION LINE AT A REDUCED WIDTH GROUND TRANSITION AREA

CROSS-REFERENCE TO RELATED APPLICATIONS

This application is a continuation application of International Application No. PCT/KR2018/001047, filed on Jan. 24, 2018, which claims priority and benefits of Korean Application No. 10-2017-0012484, filed on Jan. 26, 2017, the content of which is incorporated herein by reference in its entirety.

TECHNICAL FIELD

The present disclosure relates to a cavity type waveguide used for transmission and processing of a very high frequency signal, and more particularly, to a transmission line-waveguide transition device for connecting a printed circuit board (PCB) type transmission line, such as a microstrip line, a strip line, a coplanar waveguide (CPW), or a CPW with Ground (CPWG), with a cavity type waveguide.

ACKNOWLEDGEMENT

This work was supported by the "Cross-Ministry Giga KOREA Project" grant from the Ministry of Science, ICT and Future Planning, Korea (Assignment number: 1711021003, Sub-assignment number: GK16NI0100).

BACKGROUND ART

A waveguide structure is mainly used in a millimeter wave band having a wavelength of around a millimeter at a very high frequency such as 28 GHz or 60 GHz in order to implement a passive element exhibiting small loss and high performance (for example, a slot array antenna, a horn antenna, a filtering device, and a diplexer).

A waveguide transmits a signal using a resonance effect caused by a shielded space, that is, a waveguide structure. An approximately tubular waveguide is designed to have a length corresponding to a frequency characteristic of the transmission signal. The types and usages of waveguides can be classified according to a dielectric material with which the waveguide is filled.

Cavity-type waveguides typically have a hollow rectangular metal block structure filled with air, which has an advantage of achieving high performance with the smallest dielectric loss and excellent transmission characteristics. However, in order to couple a cavity-type waveguide to other electronic devices normally implemented as printed circuit board (PCB) type devices (i.e., in order to connect a cavity-type waveguide to a PCB type transmission line), a separate transition structure is required.

FIG. 1A shows an example of a conventional transmission line-waveguide transition device, which is disclosed in Korean Patent Application No. 10-2009-0026489 entitled "Waveguide to Microstrip Line Transition Apparatus" (Applicant: SAMSUNG THALES CO., LTD., Inventor: PARK, Dae Sung, Filing date: Mar. 27, 2009). The transition device shown in FIG. 1A has a structure that transmits a signal of a microstrip line a32 to a waveguide a10 through a slot a22 implemented on a PCB a20. The outside of the waveguide a10 and a ground of the PCB a20 are in contact with each other in the form of a via hole a24. In the structure shown in FIG. 1A, the transmission line and the waveguide are perpendicularly connected to each other. In order to arrange the waveguide so as to be parallel to the circuit board on which the transmission line is arranged, a structure for bending the waveguide by 90 degrees needs to be additionally formed, which increases the entire volume and complexity of the structure.

FIG. 1B shows another example of a conventional transmission line-waveguide transition device, which is disclosed in Korean Patent Application No. 10-2010-0040863 entitled "Wideband Transmission Line-Waveguide Transition Apparatus" (Applicant: SAMSUNG ELECTRO-MECHANICS CO., LTD., Inventor: LEE, Jung Aun, Filing date: Apr. 30, 2010). The transition device shown in FIG. 1B is a transition device between a coaxial line b22 and a waveguide. The coaxial line b22 and the waveguide are perpendicularly connected to each other and a central conductor b21*a* of the coaxial line b22 transmits a signal into the waveguide as a probe. This structure also requires, for example, the coaxial line to be bent by 90 degrees to make the waveguide and coaxial line parallel to each other. Bending the coaxial line by 90 degrees may not only require a space for the minimum turning radius but also cause a kind of crack to be produced in the outer conductor of the coaxial line.

FIG. 1C shows still another example of a conventional transmission line-waveguide transition device, which is disclosed in U.S. Pat. No. 8,188,805 entitled "Triplate line-to-waveguide transducer having spacer dimensions which are larger than waveguide dimensions" (Applicant: Hitachi Chemical Co., Ltd., Inventor: Taketo Nomura et al., Issue date: May 29, 2012). The transition device shown in FIG. 1C has a transition structure from triplate lines c1, c4, and c5 to a waveguide c6. The structure transmits a signal from a laminated line structure to the waveguide c6. The signal line c3 is located inside the laminated structure and the signal line c5 constituting a ground surface forms the top surface. The signal line c1 constituting the bottom surface is provided with an opening having similar dimensions to the inside of the waveguide to transmit a signal to the waveguide c6. In this structure, the signal line and the waveguide are perpendicular to each other. Accordingly, making the signal line and the waveguide parallel to each other requires the waveguide to be changed by 90 degrees, thereby increasing the overall size.

FIG. 1D shows yet another example of a conventional transmission line-waveguide transition device, which is disclosed in U.S. Pat. No. 6,917,256 entitled "Low loss waveguide launch" (Applicant: Motorola, Inc., Inventor: Rudy Michael Emrick et al., Issue date: Jul. 12, 2005). Referring to FIG. 2A, FIG. 2B and FIG. 2C, the transition device shown in FIG. 1D is a structure that is relatively widely applied for connection of a waveguide and a microstrip line. The transition device transitions a signal of a microstrip line d350 (FIG. 1D) to a waveguide d310 (FIG. 1D) in a perpendicular direction via a so-called back-short structure as shown in FIGS. 2A and 2B. This structure requires a space for resonance on the order of $\lambda g/4$ (where $\lambda g$ is an in-guide wavelength) on the upper side of the waveguide, that is, on the upper side of the microstrip line d350 when the waveguide is directed downward, thereby increasing the thickness of a product.

As described above, various structures have been proposed for a transmission line-waveguide transition device, and further research has been conducted to provide a simpler and more compact design and improved signal transmission performance.

SUMMARY OF THE INVENTION

Technical Problem

An object of at least some embodiments of the present disclosure is to provide a transmission line-waveguide transition device that is capable of implementing a simpler and more compact design, stabilizing characteristics, and simplifying fabrication.

Another object of at least some embodiments of the present disclosure is to provide a transmission line-waveguide transition device that enables a waveguide to be arranged parallel to and connected to a PCB type transmission line formed on a PCB without an additional bending structure of the waveguide. That is, referring to FIG. 2A schematically showing a conventional structure as shown in FIG. 1D, it can be seen that the conventional transition structure cause a PCB on which a transmission line is formed to be perpendicularly connected to a waveguide at 90 degrees. Here, as shown in FIG. 2B, in order to arrange the waveguide so as be parallel to the PCB on which the transmission line is formed, an additional waveguide bending structure should be provided. In contrast, the transmission line-waveguide transition device of the present disclosure has a very simple structure in which a PCB and a waveguide are connected to each other while being arranged parallel to each other, as shown in FIG. 2C.

Still another object of at least some embodiments of the present disclosure is to provide a transmission line-waveguide transition device that is universally applicable to various kinds of PCB type transmission lines, such as microstrip lines, strip lines, CPW, and CPWG.

Technical Solution

In accordance with one aspect of the present disclosure, provided is a transmission line-waveguide transition device including side surfaces and a top surface having a size and shape corresponding to a waveguide to which a signal of a transmission line is transmitted, the side surfaces and top surface having a plate shape; and a plate-shaped ridge formed in an inner space defined by the side surfaces and the top surface, the ridge being provided with a slope having one end connected to the transmission line and an opposite end contacting the top surface.

A portion of the ridge to be in contact with the transmission line may be formed to contact the transmission line at a gentle angle rather than a steep angle (in other words, the portion of the ridge where the ridge contacts the transmission line may have an inclination angle that gradually increases from 0 degrees with respect to the ground surface rather than a larger degrees), the ridge having a curve shape as a whole.

The transmission line-waveguide transition device may be fixedly mounted on a substrate having the transmission line by soldering or screw coupling, wherein a ground surface may be formed on the substrate at least at a position where the transition device is mounted.

A ground transition area may be formed on the ground surface at a position corresponding to the ridge by removing a part of the ground surface.

Advantageous Effects

As apparent from the foregoing, a transmission line-waveguide transition device according to at least some embodiments of the present disclosure proposes a very simple and efficient structure that transitions a signal to a waveguide by attaching the waveguide onto a PCB type transmission line in a form similar to a cover, and accordingly may simply connect the transmission line and the waveguide so as to be parallel to each other. Accordingly, the thickness of a product to which the present invention is applied may be reduced, and thus the final product may be realized to have a low profile.

In addition, the proposed structure receives a signal from the transmission line by directly contacting the transmission line and transitions the received signal to the waveguide. Accordingly, the structure may have higher stability and lower loss than a conventional coupling structure.

Further, a transition device according to at least some embodiments of the present disclosure can be assembled on a PCB without work such as soldering. Accordingly, pre-assembly characteristics can be verified and replaced for a test, thereby reducing the component loss factor. This may require only two-dimensional work of placing a cover on the PCB during mass production, thereby achieving a fast assembly process.

In particular, the transition device of the present disclosure may be widely applied to various kinds of PCB type transmission lines.

BEST MODE FOR CARRYING OUT THE INVENTION

Figure 1A:
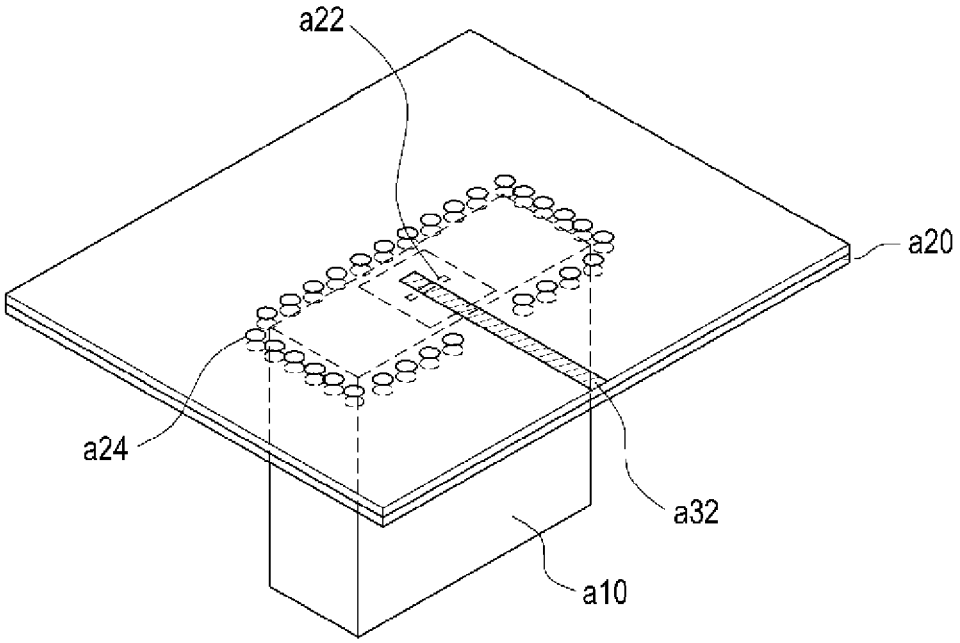
FIG. 1A (Prior Art)
FIGS. 1A, 1B, 1C, and 1D illustrate examples of conventional transmission line-waveguide transition devices.
Figure 1B:
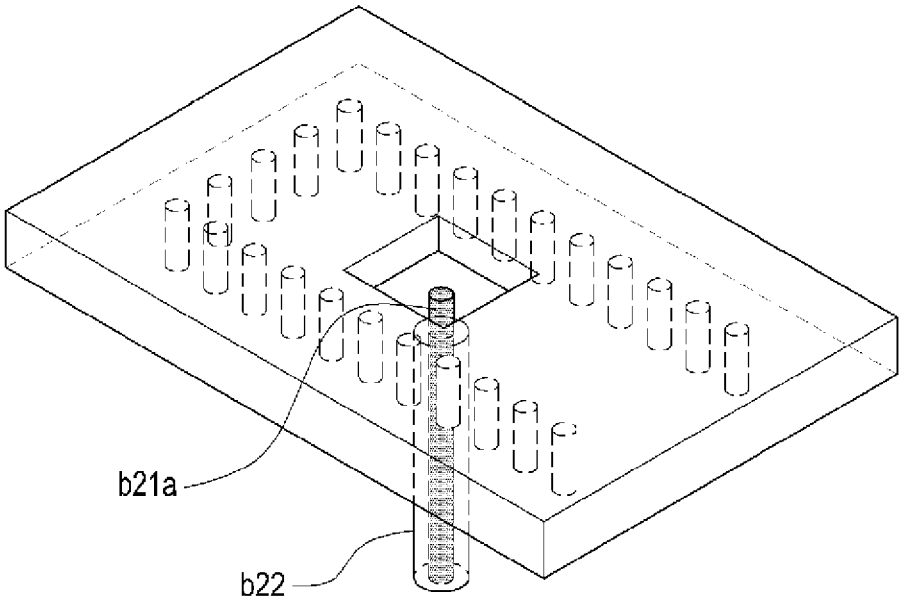
FIG. 1B (Prior Art)
Figure 1C:
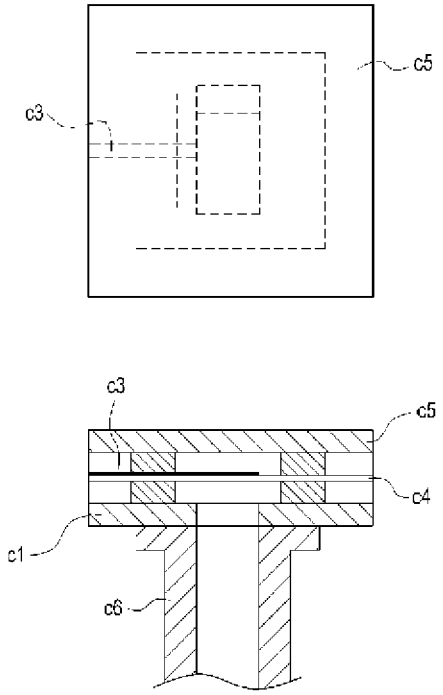
FIG. 1C (Prior Art)
Figure 1D:
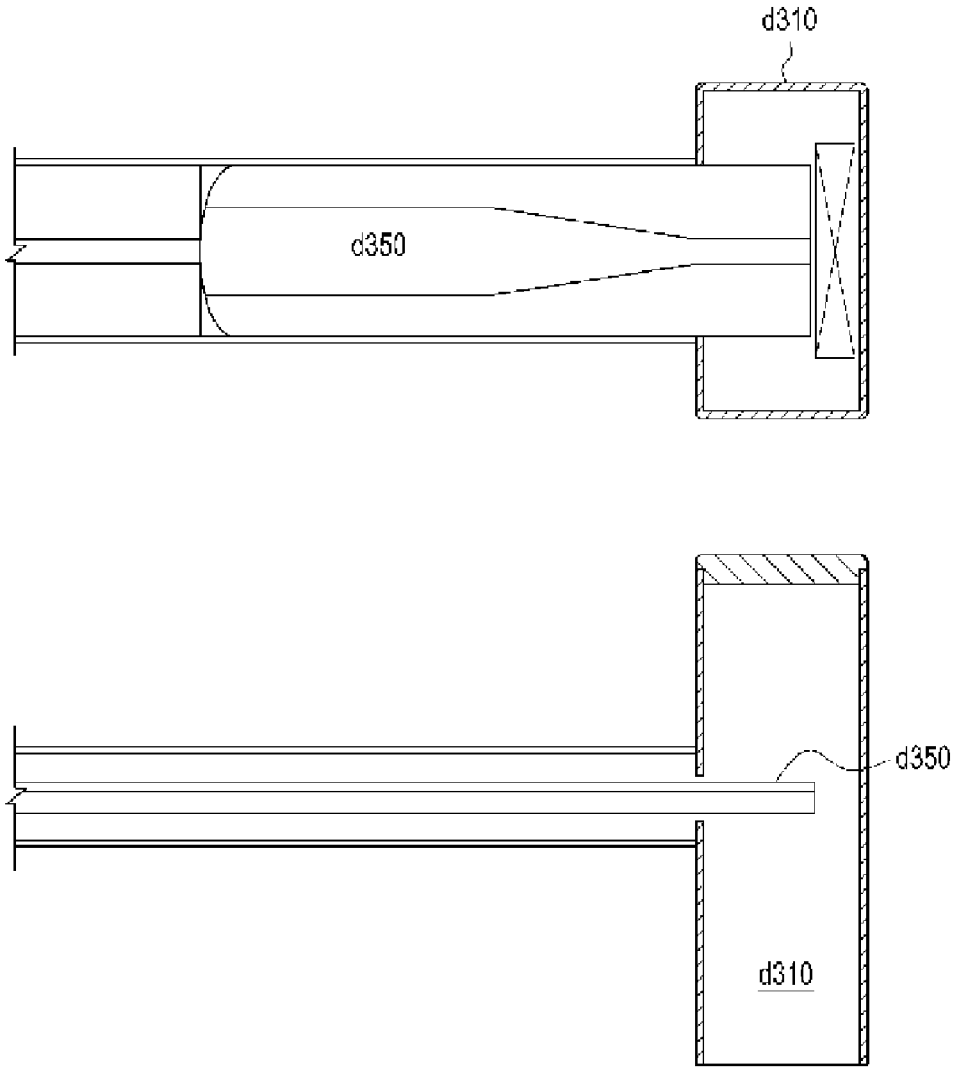
FIG. 1D (Prior Art)
Figure 2A:
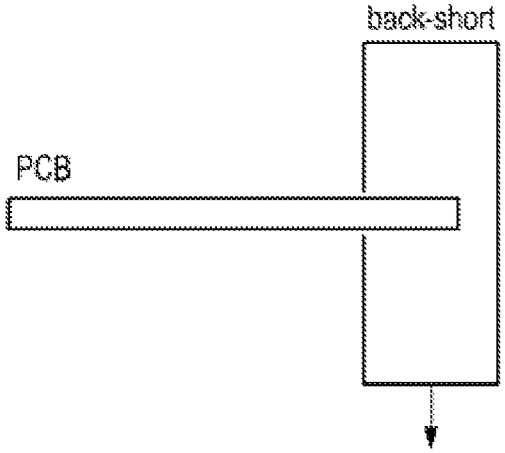
FIGS. 2A, 2B, and 2C are schematic diagrams illustrating the characteristics of a transmission line-waveguide transition device of the present disclosure.
Figure 2B:
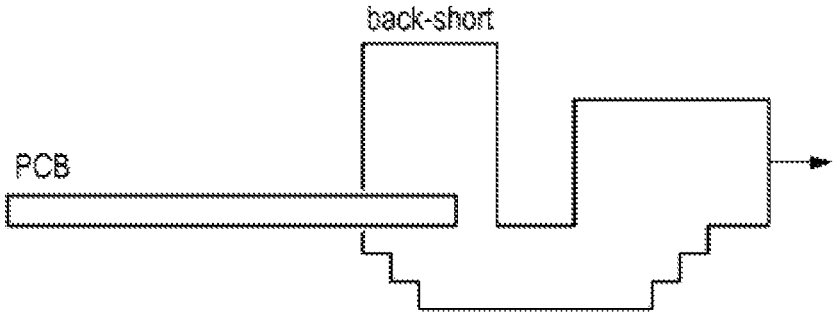
Figure 2C:
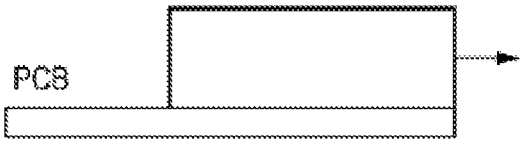

Hereinafter, preferred embodiments of the present disclosure will be described in detail with reference to the accompanying drawings. In the accompanying drawings, like reference numerals designate like elements. For simplicity, the sizes and shapes of the elements have been simplified or partially exaggerated.

Figure 3:
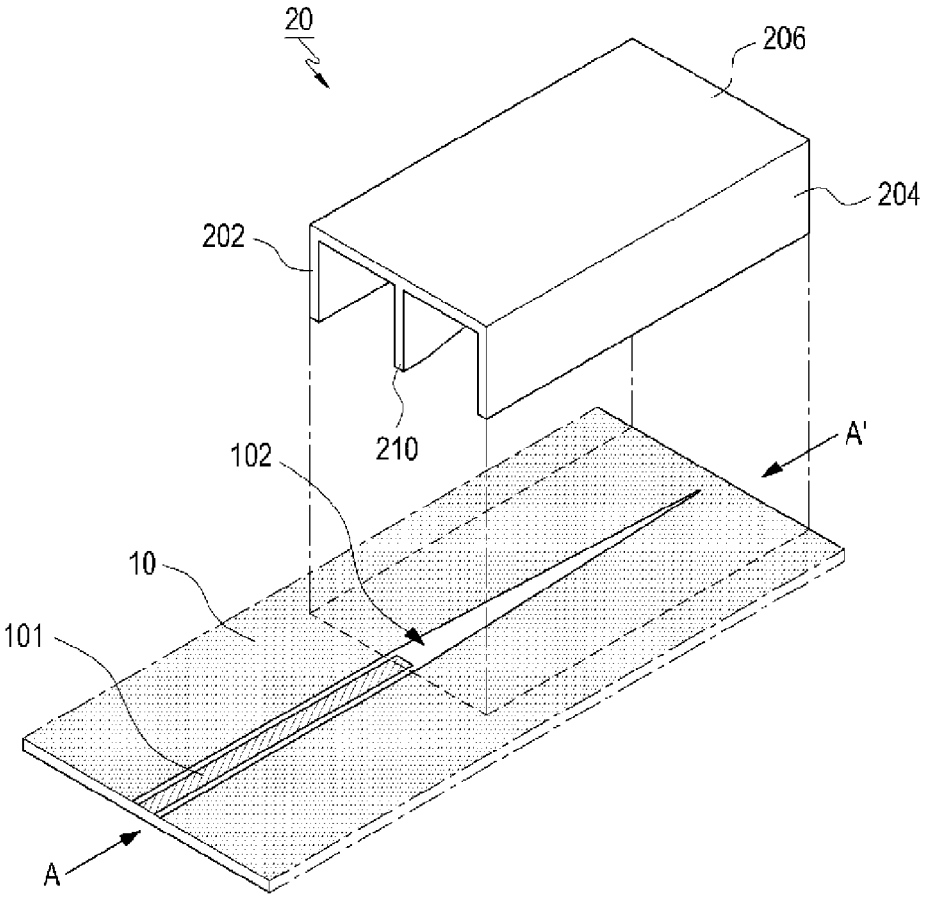
FIG. 3 is an exploded perspective view of a transmission line-waveguide transition device and a substrate on which a transmission line is formed according to a first embodiment of the present disclosure.
Figure 4:
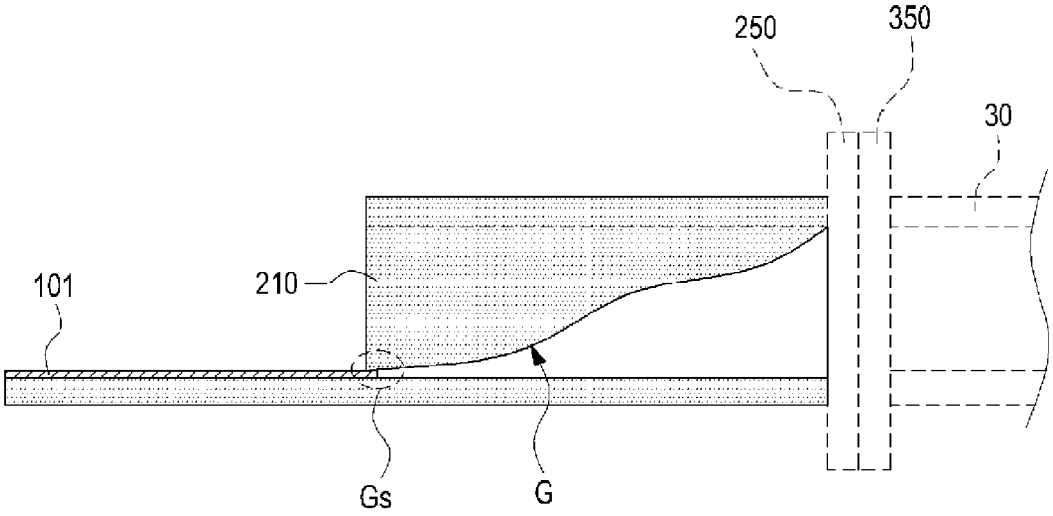
FIG. 4 is a cross-sectional view taken along line A-A' in FIG. 3.
Figure 5:
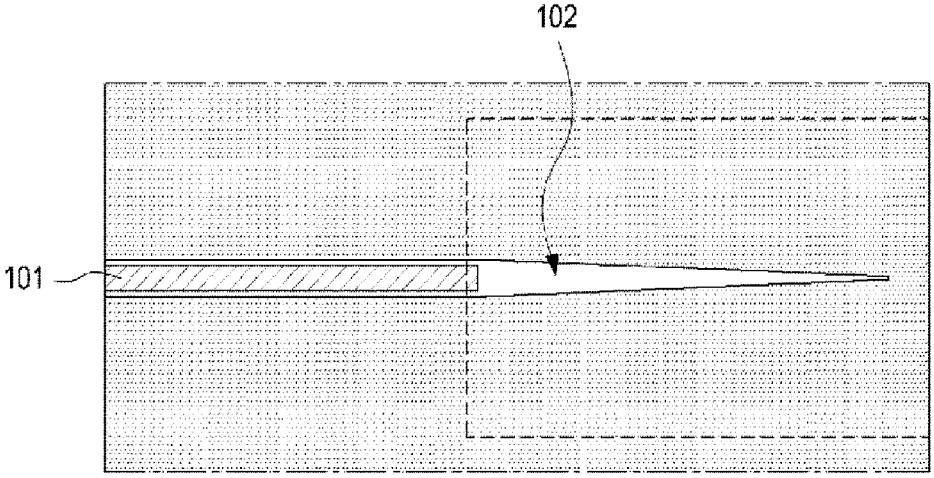
FIG. 5 is a plan view of the substrate of FIG. 3.
Figure 6A:
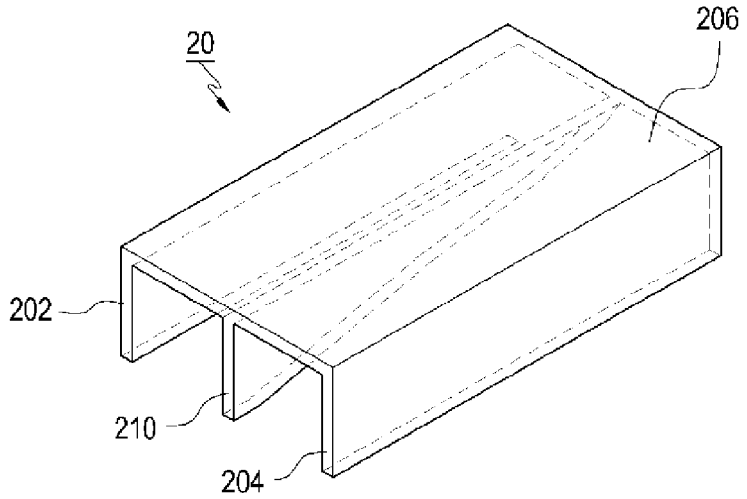
FIGS. 6A and 6B are enlarged perspective views of the transmission line-waveguide transition device of FIG. 3.
Figure 6B:
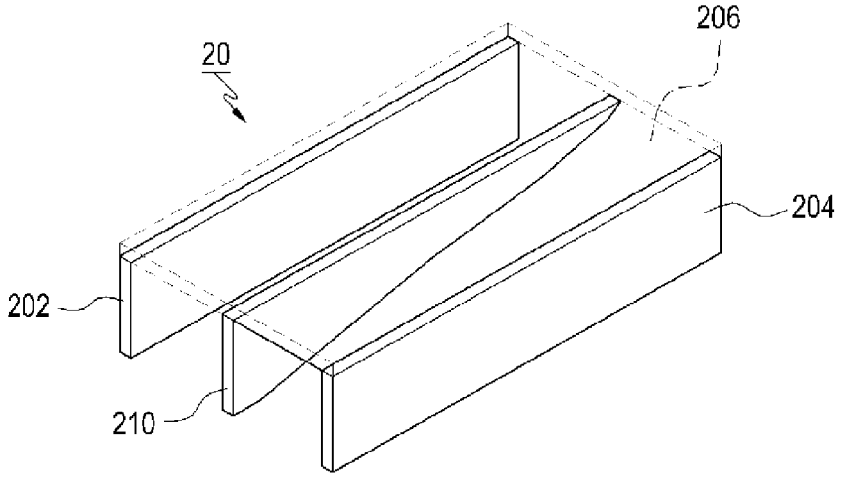

FIG. 3 is an exploded perspective view of a transmission line-waveguide transition device 20 (hereinafter referred to simply as a "transition device") and a substrate 10 on which a transmission line 101 is formed according to a first embodiment of the present disclosure, where the transmission line 101 is illustrated as being implemented as a CPW structure. FIG. 4 is a cross-sectional view taken along line A-A' in FIG. 3, showing a cross section of the transition device 20 and the transmission line 101 coupled to each other. FIG. 5 is a plan view of the substrate 10 of FIG. 3. FIGS. 6A and 6B are enlarged perspective views of the transmission line-waveguide transition device 20 of FIG. 3, in which FIG. 6B shows the internal structure of the transition device 20 more clearly by removing the top surface of the transition device 20.

Referring to FIGS. 3, 4, 5, 6A and 6B, the transmission line-waveguide transition device 20 according to the first embodiment basically includes plate-shaped side surfaces 202 and 204 and a top surface 206 as shown in FIGS. 3, 6A and 6B that have sizes and shapes corresponding to a standardized waveguide 30 (see FIG. 4) to which a signal of the transmission line 101 (FIGS. 3-5) is transmitted. That is, the inner space defined by these side surfaces 202 and 204 and top surface 206 has a size and shape corresponding to the standardized waveguide.

A plate-shaped ridge 210 (FIGS. 3, 4, 6A and 6B) having a slope G (see FIG. 4) with one end connected to the transmission line 101 on the substrate 10 and an opposite end contacting the top surface 206 is formed at the center of the inner space defined by the side surfaces 202 and 204 and the top surface 206. The width of the slope G of the ridge 210 may be designed to correspond to the width of the transmission line 101, for example, to be equal to the width of the transmission line 101.

The slope G of the ridge 210 is a main element for transitioning a signal transmitted from the transmission line 101 to the waveguide, and is pre-designed in an appropriate curve shape as a whole. That is, the curve shape of the slope G may be designed by an appropriate combination of multiple trigonometric curves. For example, a portion Gs (see FIG. 4) in contact with the transmission line 101 may be designed in the shape of a curve that starts with at least a gentle gradient. The curve shape of the slope G of the ridge 210 may be designed through multiple tests and analyses so as to be optimized according to the type of the transmission line and the frequency of the transmission signal.

Particularly, the curve shape of the portion Gs (see FIG. 4) of the ridge 210 that contacts the transmission line 101 should be designed so as to contact the transmission line 101 at a gentle angle rather than a steep angle. This is a major feature that enables effective signal transmission including improvement of junction characteristics and minimization of reflection loss at a connection point between the transmission line 101 and the ridge 210. It is found in the present disclosure that the signal transmission characteristics are deteriorated when the transmission line 101 and the ridge 210 are not connected at a gentle angle. Accordingly, in the embodiments of the present disclosure, the curve shape of the ridge 210 at at least the portion Gs where the ridge 210 contacts the transmission line 101 may be designed to have an inclination angle that gradually increases from 0 degrees with respect to the ground surface.

At the connection point, the ridge 210 and the transmission line 101 may be fixedly connected to each other using a technique of soldering or application of a conductive resin (e.g., silver epoxy). In case of connection by soldering, plating treatment for solder may be pre-performed on a corresponding portion of the ridge 210. Alternatively, the ridge 210 and the transmission line 101 may be connected to each other in a simple contact manner.

The transition device 20 embodied by the side surfaces 202 and 204 and the top surface 206 as well as the ridge 210 having the above configuration may be formed of a conductive metal such as, for example, aluminum (alloy) or copper (alloy). In some cases, the transition device 20 may be silver plated to further improve signal transmission characteristics.

The transition device 20 is fixedly mounted on the substrate 10. For example, the transition device may be fixed on the substrate 10 by, for example, soldering. In this case, the lower end portions of the side surfaces 202 and 204 of the transition device 20 may be pre-subjected to plating treatment for soldering. Alternatively, the transition device 20 may be fixedly mounted on the substrate 10 in a screw coupling manner. In this case, screw holes (not shown) may be vertically formed in the side surfaces 202 and 204 of the transition device 20 in a penetrating manner, and corresponding screw holes (grooves) may be formed in the substrate 10, such that the transition device and the substrate are coupled with each other by coupling screws. Of course, a separate flange (not shown) may be additionally formed on the side surfaces 202 and 204 of the transition device 20 for screw connection, and thus the transition device may be coupled to the substrate 10 by the flange in a screw coupling manner.

A ground surface (an area indicated by a dotted line in FIGS. 3 and 5) is formed on the substrate 10 at least at a position where the transition device 20 is mounted. In the embodiments shown in FIGS. 3, 4, 5, 6A and 6B, the transmission line 101 has the CPW structure, and thus the entire top surface of the substrate 10 is the ground surface.

As shown in FIGS. 3 and 5, a ground transition area 102 is formed on the ground surface formed on the top surface of the substrate 10 at a position corresponding to the ridge 210 of the transition device 20 by removing a part of the ground surface. The ground transition area 102 is formed to have a generally elongated triangular shape (e.g., an isosceles triangle) as the width thereof gradually decreases starting from the connection point between the ridge 210 and the transmission line 101. The ground transition area 102 is formed to improve signal transmission characteristics and impedance matching between the transmission line 101 and the waveguide. The two sides of the ground transition area 102 having the shape of an isosceles triangle may have a generally curved line shape for more precise matching of the ground characteristics in consideration of, for example, the distance to the slope G of the ridge 210.

The transition device 20 having the structure described above may further include a flange 250 for coupling with a flange 350 of the waveguide 30 as shown in FIG. 4. The waveguide 30 may be designed according to a standard specification (for example, in the band of 26.5 GHz to 40 GHz, the standard specification defines the inner size of a 'WR-28' waveguide as 7.11 mm×3.56 mm), the transition device 20 and the flange 250 are formed correspondingly. In addition to the flange structure, soldering or welding may be performed to attach the transition device 20 to the waveguide 30, or the transition device 20 may be integrated with the waveguide 30 as an end structure of the waveguide 30.

The transmission line-waveguide transition device 20 of the present disclosure, which may be configured as shown in FIGS. 3, 4, 5, 6A and 6B, can be installed in a simple manner of, for example, placing a kind of cover on the PCB substrate 10. Accordingly, it can be seen that stabilization of characteristics, simplification of assembly, and a compact design can be realized. In particular, since the transition device can be connected directly to the waveguide while being arranged parallel to the waveguide, the product may remain thin as a whole.

Figure 7:
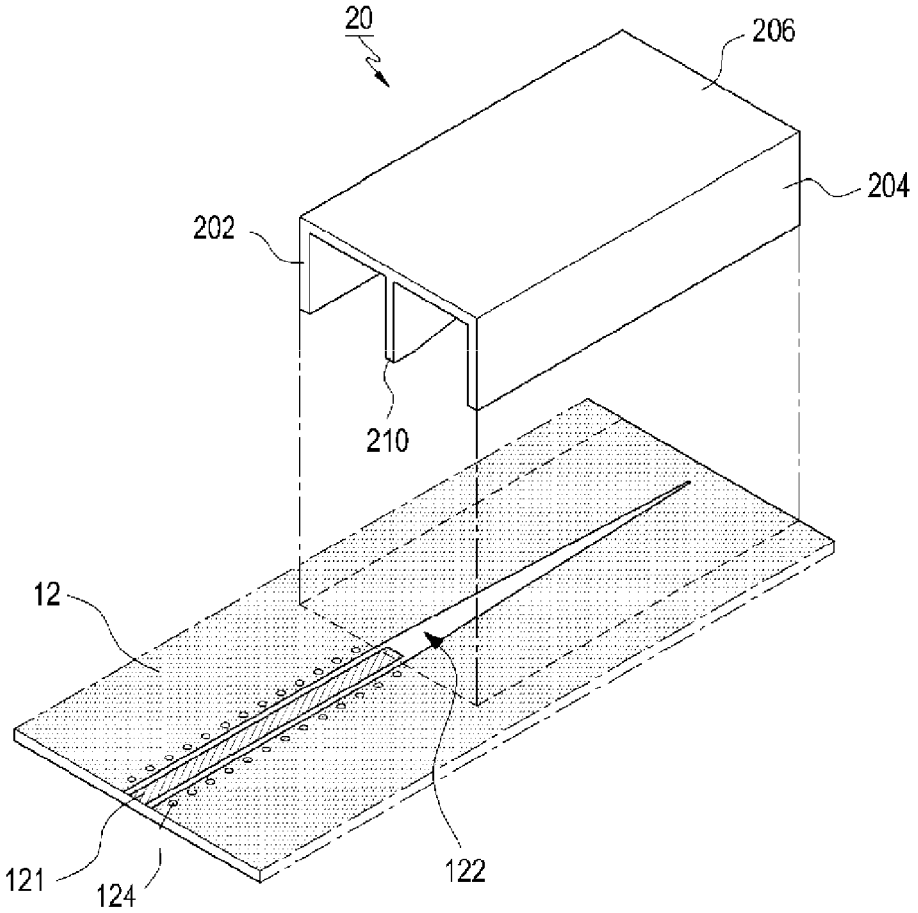
FIG. 7 is an exploded perspective view of a transmission line-waveguide transition device and a substrate on which a transmission line is formed according to a second embodiment of the present disclosure.

FIG. 7 is an exploded perspective view of the transmission line-waveguide transition device 20 and a substrate 12 on which a transmission line 121 is formed according to a second embodiment of the present disclosure, where the transmission line 121 is illustrated as being implemented as a CPWG structure. The transmission line 121 and a ground surface are formed on the top surface of the substrate 12 of the CPWG structure, and a ground surface is formed on the bottom surface of the substrate. In the example of FIG. 7, it is illustrated that multiple via holes 124 are formed around the transmission line 121 to improve grounding.

Referring to FIG. 7, the transmission line-waveguide transition device 20 according to the second embodiment includes side surfaces 202 and 204, a top surface 206 and a ridge 210, which are substantially identical to the elements shown in FIGS. 3, 4, 5, 6A and 6B. Herein, one end of the ridge 210 comes into contact with the transmission line 121 of the CPWG structure. Further, the ridge 210 may have an appropriately pre-designed slope of a curve shape, like the structure of the first embodiment.

A ground surface (an area indicated by a dotted line in FIG. 7) is formed on the substrate 12 at least at a position where the transition device 20 is mounted, and a ground transition area 122 is formed at a position corresponding to the ridge 210 of the transition device 20 by removing a part of the ground surface in the same manner as in the structure of the first embodiment.

Figure 8:
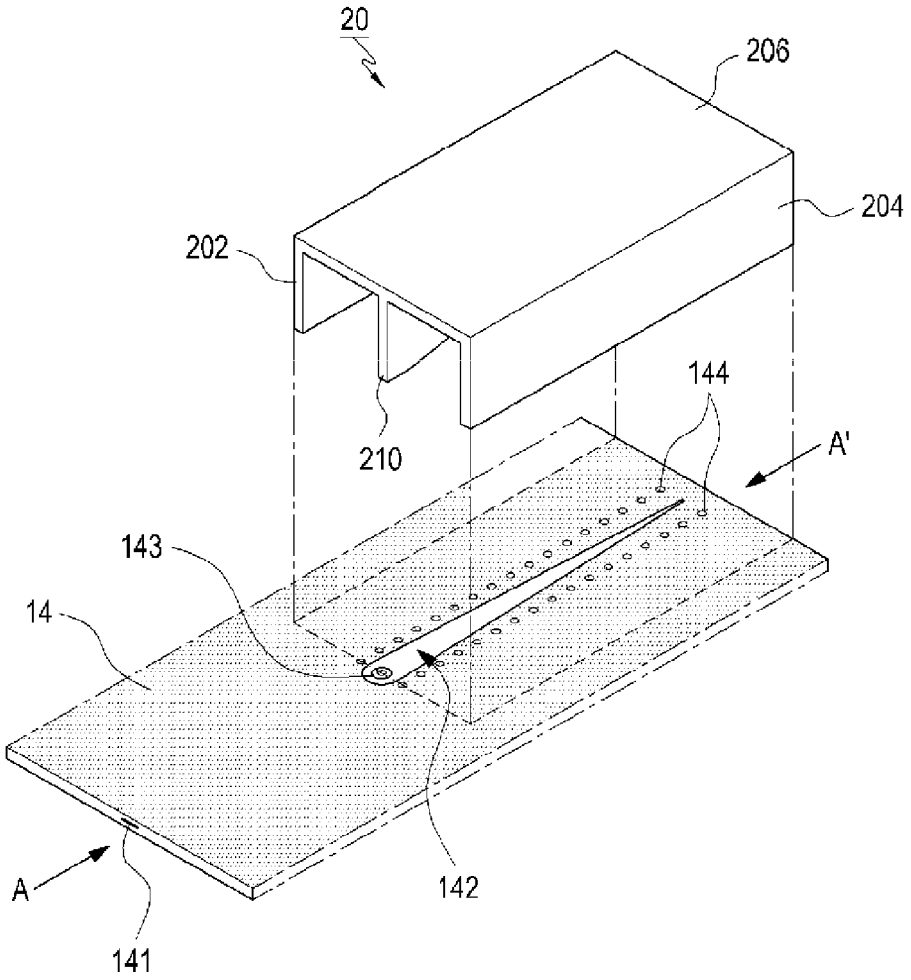
FIG. 8 is an exploded perspective view of a transmission line-waveguide transition device and a substrate on which a transmission line is formed according to a third embodiment of the present disclosure.
Figure 9:
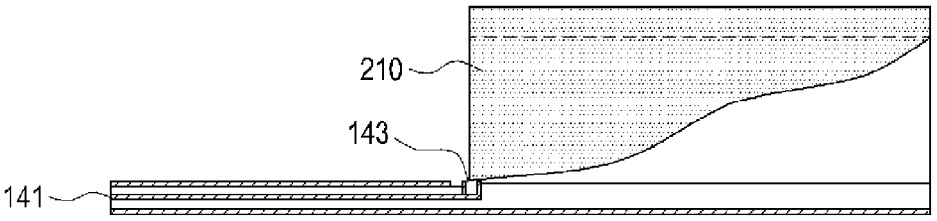
FIG. 9 is a cross-sectional view taken along line A-A' in FIG. 8.

FIG. 8 is an exploded perspective view of the transmission line-waveguide transition device 20 and a substrate 14 on which a transmission line 141 is formed according to a third embodiment of the present disclosure, wherein the transmission line 141 is illustrated as being implemented as a strip line structure. FIG. 9 is a cross-sectional view taken along line A-A' in FIG. 8, showing a cross section of the transition device 20 and the substrate 14 coupled to each other. A ground surface is formed on the top and bottom surfaces of the substrate 14 of the strip line structure, and the transmission line 141 is embedded in a non-conductive dielectric layer, which is the inner layer of the substrate.

Referring to FIGS. 8 and 9, the transmission line-waveguide transition device 20 according to the third embodiment is substantially similar to the previous embodiments in that the transition device includes side surfaces 202 and 204, a top surface 206 as shown in FIG. 8, and a ridge 210. A metal via hole 143 is further through the substrate 14 so as to be connected to the end of the transmission line 141 in the inner layer of the substrate in order to connect the ridge 210 and the transmission line 141 of the strip line structure. The ridge 210 contacts the metal via hole 143 and is thus connected to the transmission line 141.

A ground surface (an area indicated by a dotted line in FIG. 8) is formed on the substrate 14 at least at a position where the transition device 20 is mounted, and a ground pattern is removed from the periphery of the via hole 143. A ground transition area 142 (FIG. 8) is formed at a position corresponding to the ridge 210 of the transition device 20 by removing a part of the ground surface in the same manner as in the structures of the previous embodiments. In the structure of the third embodiment shown in FIGS. 8 and 9, multiple via holes 144 may be formed through the substrate 14 such that the top surface ground and bottom surface ground of the substrate are connected to each other to improve grounding around the ground transition area 142.

Figure 10:
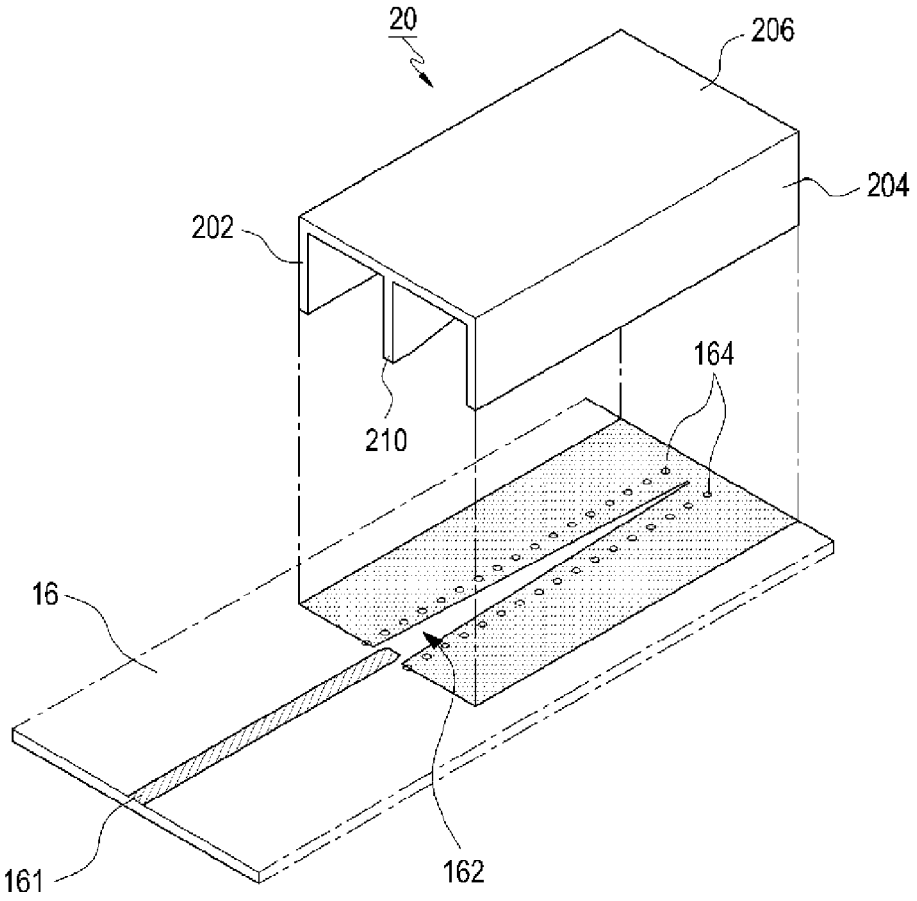
FIG. 10 is an exploded perspective view of a transmission line-waveguide transition device and a substrate on which a transmission line is formed according to a fourth embodiment of the present disclosure.

FIG. 10 is an exploded perspective view of the transmission line-waveguide transition device and a substrate on which a transmission line is formed according to a fourth embodiment of the present disclosure, wherein the transmission line 161 is illustrated as being implemented as a microstrip line structure. A pattern of the transmission line 161 is basically formed on the top surface of the substrate 16 of the microstrip line structure, and a ground surface is formed on the bottom surface of the substrate.

Referring to FIG. 10, the transmission line-waveguide transition device 20 according to a fourth embodiment of the present disclosure includes side surfaces 202 and 204, a top surface 206, and a ridge 210 as in the previous embodiments. Here, the ridge 210 is arranged so as to contact the transmission line 161 of the microstrip line structure.

A separate ground surface is additionally formed on the substrate 16 at a position where at least the transition device 20 is mounted. A ground transition area 162 is formed on the ground surface additionally formed on the top surface of the substrate 16, at a position corresponding to the ridge 210 by removing a part of the ground surface, as in the previous embodiments. In addition, multiple via holes 164 may be formed in the periphery of the ground transition area 162 through the substrate 16 to improve grounding. Thereby, the ground surface additionally formed on the top surface of the substrate may be connected to the ground surface formed on the bottom surface of the substrate.

Figure 11A:
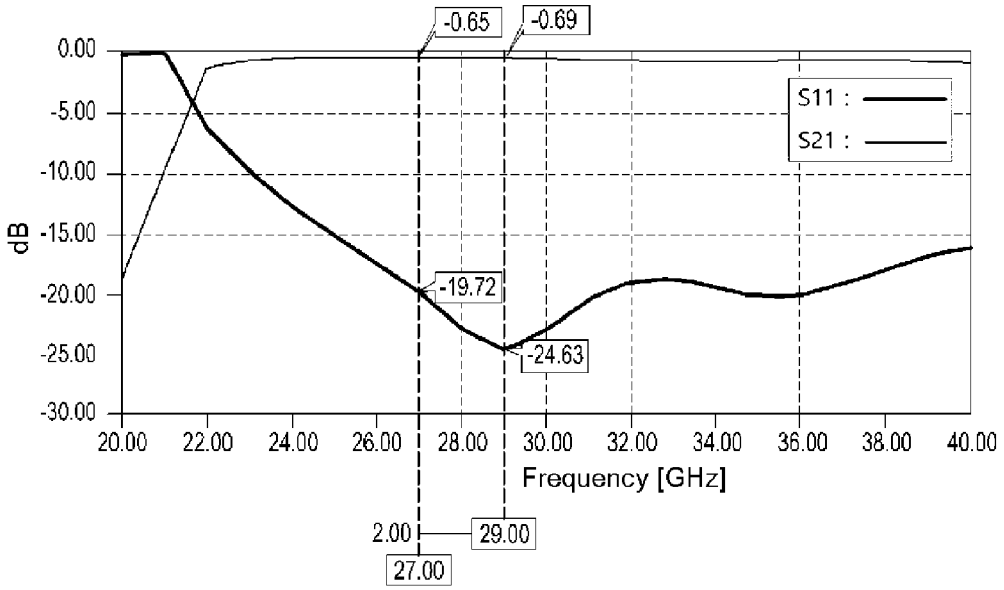
FIGS. 11A, 11B, 11C, and 11D are graphs depicting characteristics of transmission line-waveguide transition devices according to various embodiments of the present disclosure.
Figure 11B:
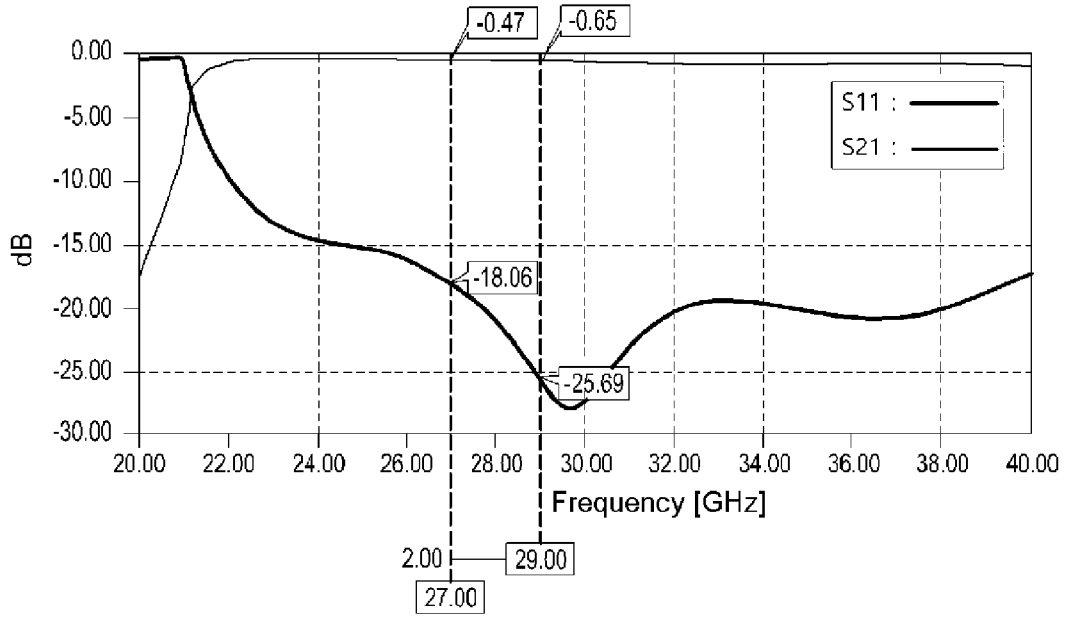
Figure 11C:
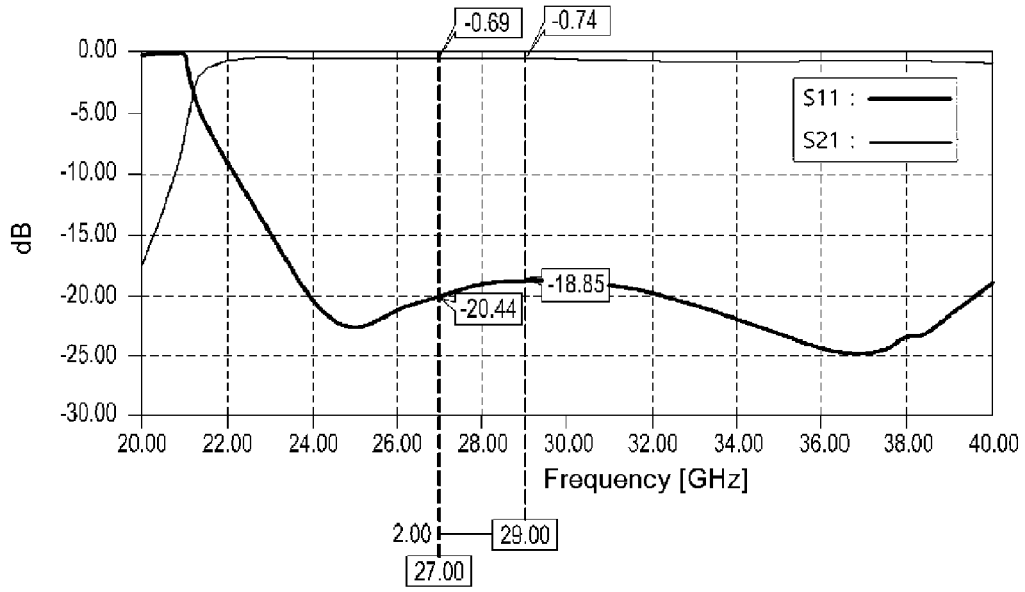
Figure 11D:
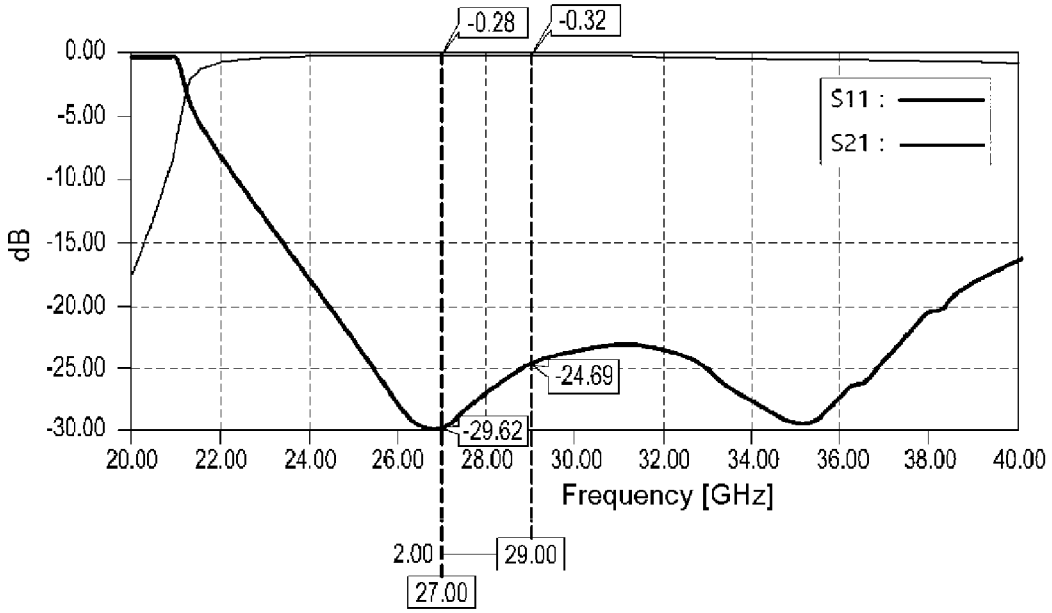

FIGS. 11A, 11B, 11C, and 11D are graphs depicting characteristics of transmission line-waveguide transition devices according to various embodiments of the present disclosure, showing the characteristics of the transition devices 20 according to the first, second, third and fourth embodiments. As shown in FIG. 11A, it can be seen that the reflection loss S11 is −19.72 dB and the insertion loss S21 is −0.65 dB when the frequency is 27.00 GHz, and, the reflection loss S11 is −24.63 dB and the insertion loss S21 is −0.69 dB when the frequency is 29.00 GHz. As show in FIG. 11B, it can be seen that the reflection loss S11 is −18.06 dB and the insertion loss S21 is −0.47 dB when the frequency is 27.00 GHz, and, the reflection loss S11 is −25.69 dB and the insertion loss S21 is −0.65 dB when the frequency is 29.00 GHz. As show in FIG. 11C, it can be seen that the reflection loss S11 is −20.44 dB and the insertion loss S21 is −0.69 dB when the frequency is 27.00 GHz, and, the reflection loss S11 is −18.85 dB and the insertion loss S21 is −0.74 dB when the frequency is 29.00 GHz. As show in FIG. 11D, it can be seen that the reflection loss S11 is −29.62 dB and the insertion loss S21 is −0.28 dB when the frequency is 27.00 GHz, and, the reflection loss S11 is −24.69 dB and the insertion loss S21 is −0.32 dB when the frequency is 29.00 GHz. As shown in FIGS. 11A to 11D, it can be seen that the reflection loss S11 in each of the transition devices 20 is sufficiently secured as the −15 dB bandwidth with respect to a desired band, for example, a 28 GHz band. It can also be seen that the insertion loss S21 is within about −0.75 dB and can be designed to be very small. Since part of the loss results from the dielectric substrate, it can be inferred that the actual insertion loss of the transition structure is very small, so as to be negligible.

As in the structures of the first to fourth embodiments of the present disclosure, the transmission line-waveguide transition device according to the present disclosure is applicable to a variety of transmission line structures including a CPW (FIG. 11A), a CPWG (FIG. 11B), a strip line (FIG. 11C), and a microstrip line (FIG. 11D) on single-layered and multi-layered substrates of any shape.

Figure 12A:
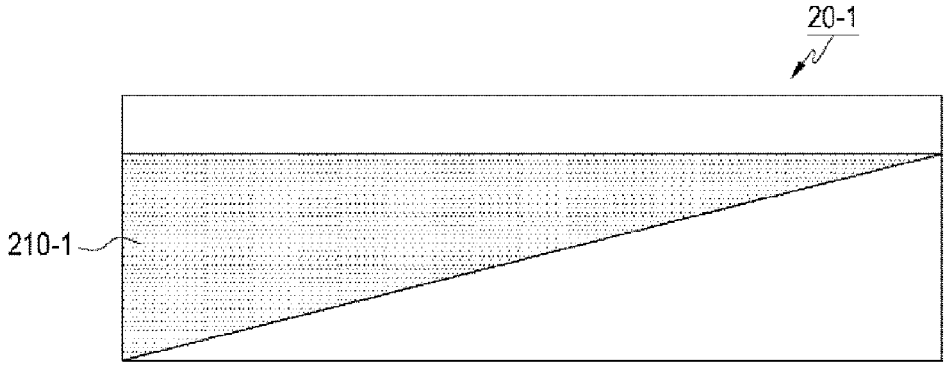
FIGS. 12A, 12B, and 12C illustrate variations of a ridge structure that is applicable to transition devices according to various embodiments of the present disclosure.
Figure 12B:
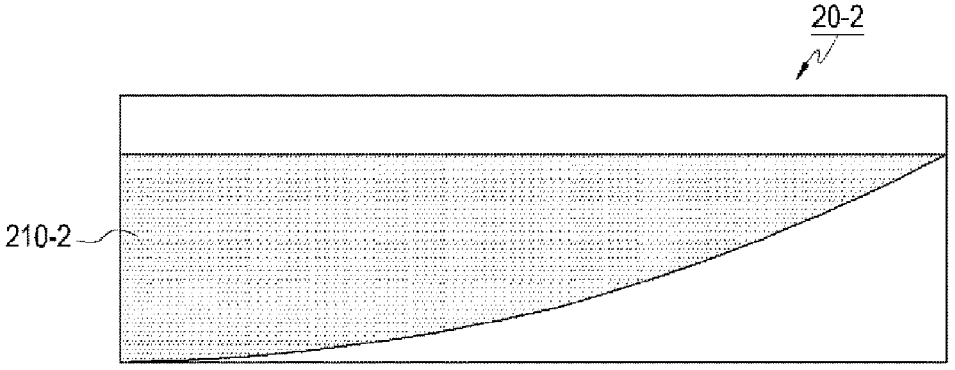
Figure 12C:
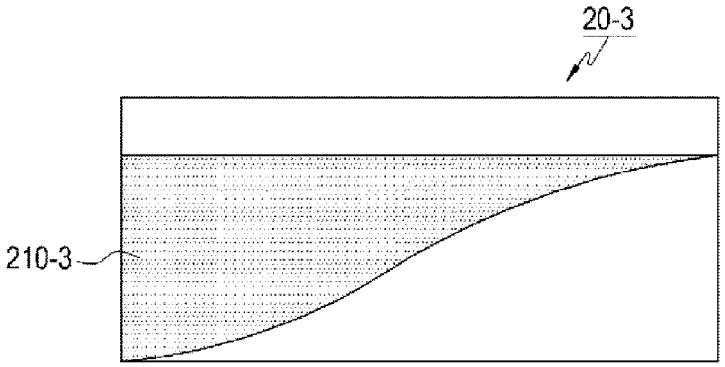

FIGS. 12A, 12B, and 12C illustrate variations of a ridge structure that is applicable to transition devices according to various embodiments of the present disclosure, in which the different curve shapes of the slope of the ridge can be designed. That is, the slope of the ridge 210-1 of the transition device 20-1 shown in FIG. 12A is a straight line, and the slope of the ridge 210-2 of the transition device 20-2 shown in FIG. 12B is a curve that has a small degree of inclination at the start point of the slope section and a large degree of inclination at the end point of the section. The slope of the ridge 210-3 of the transition device 20-3 shown in FIG. 12C is an S-shaped curve having a small degree of inclination at the start and end points of the slope section, similar to a logistic function or a part of a trigonometric function.

Figure 13:
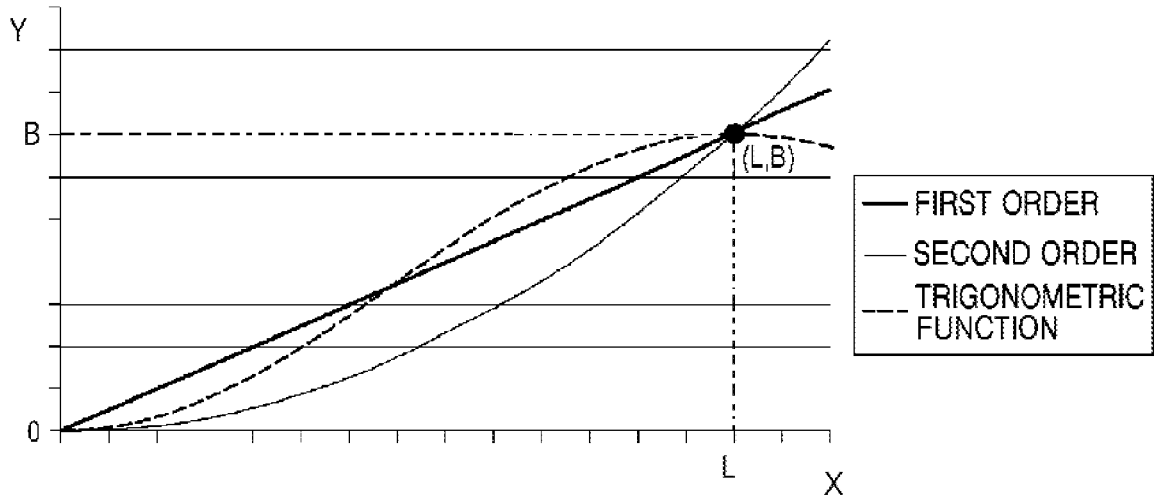
FIG. 13 is a graph of a function model applied in designing slopes of the ridge structures of FIGS. 12A, 12B and 12C.

FIG. 13 is a graph of function models applied in designing slopes of the ridge structures of FIGS. 12A, 12B and 12C. Referring to FIG. 13, the linear shape of the slope of the ridge 210-1 in FIG. 12A may be designed using a first-order function, and the curve shape of the slope of the ridge 210-2 in FIG. 12B may be designed using a second-order function. The "S" shape of the slope of the ridge 210-3 in FIG. 12C may be designed using a trigonometric function. The functions may be set to satisfy, for example, the following equations, respectively. Here, although not limited thereto, L may have a value of 15, and B may have a value of 3.5, as illustrated in FIG. 13.

[Equations]

First-order function: $y=B/L*x$

Second-order function: $y=(B/L\hat{}2)*x\hat{}2$

Trigonometric function $y=-0.5*B*\cos(\pi/L*x)+0.5*B$

Herein, L denotes the length of a transition structure, and B denotes the height of the transition structure (i.e., height of the waveguide).

The graph of the curves of the respective functions shown in FIG. 13 models the shape of the slope of the ridge by setting the portion of the PCB contacting the transmission line to the origin (0, 0). Thus, a function of a curve passing through the origin and the end point (L, B) (where L is the ridge length in millimeters and B is the ridge height in millimeters) of a slope may be appropriately set, and thus the slope of the ridge may be designed.

In this case, a structure having a smaller loss for a shorter length L of the ridge, that is, a shorter length of the transition structure may be an optimum structure. In this sense, the structure using a trigonometric function having a small degree of inclination at the start point (0, 0) and the end point (L, B) of the transition structure in the above example is an excellent structure. Regarding the ridge structures, other optimization may be applied depending on a structure employed, the thickness of the PCB, the width of the transmission line, and the like. In addition, different function models may be applied to each part of the ridge in designing the whole slope of a ridge.

As described above, in various embodiments of the present disclosure, the shape of the ridge of the transition device may be optimized by modeling curve shapes of various functions. According to the present disclosure, since transition from a PCB type transmission line to a waveguide is performed through a single transition structure, a function model having excellent characteristics among various function models can be derived and adopted.

As described above, the transmission line-waveguide transition device according to various embodiments of the present disclosure may be configured and operated. While specific embodiments of the present invention have been described above, it is to be understood that various other embodiments and modifications may be made in the present invention. For example, the length of the transition device 20, the curve shape of the slope G of the ridge 210 as shown in FIG. 4, and the like may be differently designed in consideration of characteristics required of a product. In addition to the transmission line mentioned in the above embodiments, the transition device 20 of the present disclosure may also be applied to, for example, a coaxial line. In this case, the inner conductor of the coaxial line may be connected to the ridge.

As such, various modifications and variations of the present disclosure may be made without departing from the spirit and scope of the present disclosure as defined by the appended claims and their equivalents.

The invention claimed is:

1. A transmission line-waveguide transition device comprising:

side surfaces and a top surface having a size and shape corresponding to a waveguide to which a signal of a transmission line is transmitted, the side surfaces and top surface having a plate shape; and a plate-shaped ridge formed in an inner space defined by the side surfaces and the top surface, the ridge being provided with a slope having one end connected to the transmission line and an opposite end contacting the top surface, wherein the transmission line-waveguide transition device is fixedly mounted on a substrate having the transmission line, wherein a ground surface is formed on the substrate at least at a position where the transition device is mounted, wherein a ground transition area is formed on the ground surface at a position corresponding to the ridge, and wherein the ground transition area is formed to have a width that is reduced starting from a contact point between the ridge and the transmission line.

2. The transmission line-waveguide transition device of claim 1, wherein the ridge has a curve shape as a whole.

3. The transmission line-waveguide transition device of claim 2, wherein the curve shape of the ridge is approximately an "S" shape.

4. The transmission line-waveguide transition device of claim 1, wherein a portion of the ridge contacting the transmission line is connected to the transmission line by soldering, application of a conductive resin, or contact.

5. The transmission line-waveguide transition device of claim 1, wherein the transmission line has a strip line structure, and the ridge is connected to the transmission line by a via hole formed in the substrate of the transmission line.

6. The transmission line-waveguide transition device of claim 1, wherein the ground transition area is formed on the ground surface at a position corresponding to the ridge by removing a part of the ground surface.

7. The transmission line-waveguide transition device of claim 6, wherein a plurality of via holes is formed around the ground transition area.

8. The transmission line-waveguide transition device of claim 1, wherein the transmission line has a coplanar waveguide (CPW) structure, a CPW with Ground (CPWG) structure, or a microstrip line structure.

9. The transmission line-waveguide transition device of claim 1, further comprising:

a flange for coupling with a flange of the waveguide.

10. The transmission line-waveguide transition device of claim 1, wherein the reduced width of the ground transition area has a shape of a triangle, and one edge of the triangle is in contact with a contact point between the ridge and the transmission line.

11. The transmission line-waveguide transition device of claim 10, wherein the triangle shape of the ground transition area has a shape of an isosceles triangle.

12. A transmission line-waveguide transition device comprising:

side surfaces and a top surface having a size and shape corresponding to a waveguide to which a signal of a transmission line is transmitted, the side surfaces and top surface having a plate shape; and a plate-shaped ridge formed in an inner space defined by the side surfaces and the top surface, the ridge being provided with a slope having one end connected to the transmission line and an opposite end contacting the top surface, wherein the transmission line-waveguide transition device is fixedly mounted on a substrate having the transmission line, wherein a ground surface is formed on the substrate at least at a position where the transition device is mounted, wherein a ground transition area is formed on the ground surface at a position corresponding to the ridge by removing a part of the ground surface, and wherein the inner space is open to the substrate.

* * * * *